US011448025B2

(12) United States Patent
Covalt et al.

(10) Patent No.: US 11,448,025 B2
(45) **Date of Patent: *Sep. 20, 2022**

(54) IMPACT RESISTANT MATERIAL IN SETTING TOOL

(71) Applicant: Hunting Titan, Inc., Pampa, TX (US)

(72) Inventors: Johnny Covalt, Burleson, TX (US); Joseph Albert Henke, Hallettsville, TX (US)

(73) Assignee: Hunting Titan, Inc., Pampa, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/112,875

(22) Filed: Dec. 4, 2020

(65) Prior Publication Data

US 2021/0087897 A1 Mar. 25, 2021

Related U.S. Application Data

(63) Continuation-in-part of application No. 16/970,260, filed as application No. PCT/US2019/019261 on Feb. 22, 2019.

(60) Provisional application No. 62/634,734, filed on Feb. 23, 2018, provisional application No. 62/944,453, filed on Dec. 6, 2019.

(51) Int. Cl.

| | |
|---|---|
| ***E21B 23/04*** | (2006.01) |
| ***E21B 23/06*** | (2006.01) |
| ***E21B 33/134*** | (2006.01) |

(52) U.S. Cl.
CPC ..... *E21B 23/042* (2020.05); *E21B 23/0415* (2020.05); *E21B 23/06* (2013.01); *E21B 33/134* (2013.01)

(58) Field of Classification Search
CPC .... E21B 23/04115; E21B 23/04; E21B 23/06; E21B 23/065; E21B 23/0415
See application file for complete search history.

(56) References Cited

U.S. PATENT DOCUMENTS

| | | | | |
|---|---|---|---|---|
| 2,602,513 | A | 7/1952 | Conrad et al. | |
| 2,644,529 | A | 7/1953 | Baker | |
| 6,123,242 | A * | 9/2000 | Kersten | B25C 1/14 173/212 |
| 9,810,035 | B1 | 11/2017 | Carr et al. | |
| 2016/0168936 | A1 | 6/2016 | Carisella et al. | |
| 2016/0295935 | A1 * | 10/2016 | Foster | B32B 3/14 |
| 2019/0024499 | A1 * | 1/2019 | Difoggio | E21B 47/017 |

OTHER PUBLICATIONS

Notification of Transmittal of the International Search Report and the Written Opinion of the International Searching Authority, PCT Application No. PCT/US19/19261, dated Jun. 14, 2019, 9 pages.

* cited by examiner

*Primary Examiner* — Kristyn A Hall

(57) ABSTRACT

A method and apparatus for using a plurality of impact dampening discs composed of a closed cell polyurethane foam composite with polyborodimethylsiloxane as a dilatant non-Newtonian fluid dispersed through a foam matrix in a downhole setting tool to absorb the energy released during setting operations.

12 Claims, 7 Drawing Sheets

IMPACT RESISTANT MATERIAL IN SETTING TOOL

RELATED APPLICATIONS

This application is a continuation in part of U.S. application Ser. No. 16,970,260, filed on Aug. 14, 2020, which is a 371 of International Application No. PCT/US19/19261 filed Feb. 22, 2019, which claims priority to U.S. Provisional Application No. 62/634,734, filed Feb. 23, 2018. This application claims priority to U.S. Provisional Application No. 62/944,453, filed Dec. 6, 2019.

BACKGROUND OF THE INVENTION

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically a wellbore will be drilled from a surface location, placing a hole into a formation of interest. Completion equipment will be put into place, including casing, tubing, and other downhole equipment as needed. Perforating the casing and the formation with a perforating gun is a well-known method in the art for accessing hydrocarbon deposits within a formation from a wellbore.

Explosively perforating the formation using a shaped charge is a widely known method for completing an oil well. A shaped charge is a term of art for a device that when detonated generates a focused output, high energy output, and/or high velocity jet. This is achieved in part by the geometry of the explosive in conjunction with an adjacent liner. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates, the liner metal is compressed into a superheated, super pressurized jet that can penetrate metal, concrete, and rock. Perforating charges are typically used in groups. These groups of perforating charges are typically held together in an assembly called a perforating gun. Perforating guns come in many styles, such as strip guns, capsule guns, port plug guns, and expendable hollow carrier guns.

Perforating charges are typically detonated by detonating cord in proximity to a priming hole at the apex of each charge case. Typically, the detonating cord terminates proximate to the ends of the perforating gun. In this arrangement, an initiator at one end of the perforating gun can detonate all of the perforating charges in the gun and continue a ballistic transfer to the opposite end of the gun. In this fashion, numerous perforating guns can be connected end to end with a single initiator detonating all of them.

The detonating cord is typically detonated by an initiator triggered by a firing head. The firing head can be actuated in many ways, including but not limited to electronically, hydraulically, and mechanically.

Expendable hollow carrier perforating guns are typically manufactured from standard sizes of steel pipe with a box end having internal/female threads at each end. Pin ended adapters, or subs, having male/external threads are threaded one or both ends of the gun. These subs can connect perforating guns together, connect perforating guns to other tools such as setting tools and collar locators, and connect firing heads to perforating guns. Subs often house electronic, mechanical, or ballistic components used to activate or otherwise control perforating guns and other components.

Perforating guns typically have a cylindrical gun body and a charge tube, or loading tube that holds the perforating charges. The gun body typically is composed of metal and is cylindrical in shape. Charge tubes can be formed as tubes, strips, or chains. The charge tubes will contain cutouts called charge holes to house the shaped charges.

It is generally preferable to reduce the total length of any tools to be introduced into a wellbore. Among other potential benefits, reduced tool length reduces the length of the lubricator necessary to introduce the tools into a wellbore under pressure. Additionally, reduced tool length is also desirable to accommodate turns in a highly deviated or horizontal well. It is also generally preferable to reduce the tool assembly that must be performed at the well site because the well site is often a harsh environment with numerous distractions and demands on the workers on site.

Electric initiators are commonly used in the oil and gas industry for initiating different energetic devices down hole. Most commonly, 50-ohm resistor initiators are used. Other initiators and electronic switch configurations, such as the Hunting ControlFire technology and DynaSelect technology, are also common.

In setting tools a metering fluid, typically an oil, is used to dampen any violent shock forces due to the actuation of the setting tool.

Bridge plugs are often introduced or carried into a subterranean oil or gas well on a conduit, such as wire line, electric line, continuous coiled tubing, threaded work string, or the like, for engagement at a pre-selected position within the well along another conduit having an inner smooth inner wall, such as casing. The bridge plug is typically expanded and set into position within the casing. The bridge plug effectively seals off one section of casing from another. Several different completions operations may commence after the bridge plug is set, including perforating and fracturing. Sometimes a series of plugs are set in an operation called "plug and perf" where several sections of casing are perforated sequentially. When the bridge plug is no longer needed the bridge plug is reamed, often though drilling, reestablishing fluid communication with the previously sealed off portion of casing.

Setting a bridge plug typically requires setting a "slip" mechanism that engages and locks the bridge plug with the casing, and energizing the packing element in the case of a bridge plug. This requires large forces, often in excess of 20,000 lbs. The activation or manipulation of some setting tools involves the activation of an energetic material such as an explosive pyrotechnic or black powder charge to provide the energy needed to deform a bridge plug. The energetic material may use a relatively slow burning chemical reaction to generate high pressure gases. One such setting tool is the Model E-4 Wireline Pressure Setting Tool of Baker International Corporation, sometimes referred to as the Baker Setting Tool.

After the bridge plug is set, the explosive setting tool remains pressurized and must be raised to the surface and depressurized. This typically entails bleeding pressure off the setting tool by piercing a rupture disk or releasing a valve.

SUMMARY OF EXAMPLE EMBODIMENTS

An example embodiment may include a setting tool comprising a first cylindrical body with an inner bore, a second cylindrical body with an inner bore, being coaxial with and coupled to the first cylindrical body, a third cylindrical body slideably with a first end engaged to the inner bore of the first cylindrical body and having an inner cavity with an axial opening at the first end adapted to accept a power charge and a having a distal end with a shoulder slideably engaged with the second cylindrical body inner bore, a fourth cylindrical body with a first end coupled to the distal end of the third cylindrical body and having a distal end with a transverse slot, a fifth cylindrical body fixed to the distal end of the second cylindrical body and having an inner bore wherein the fourth cylindrical body is slideably engaged therewith and further having a radial face within the second cylindrical body, a disc shaped impact dampening material with a hollow center having the fourth cylindrical body is located therethrough and coupled to the radial face of the fifth cylindrical body, and a sixth cylindrical body coupled to the fifth cylindrical body and having a transverse slot; wherein the shoulder of the third cylindrical body engages the disc shaped impact dampening material when the third cylindrical body travels a predetermined distance within the second cylindrical body.

A variation of the example embodiment may include the inner cavity of the third cylindrical body forming a power charge chamber. The fourth cylindrical body may be a piston. A chamber may be formed by the first piston and the cylindrical body.

An example embodiment may include a setting tool apparatus comprising a cylindrical body having a center axis, a first end, a second end, an inner surface, and an outer surface, a first piston located within the cylindrical body and axially aligned with the cylindrical body, having a first end and a second end, the first end coupled to a second cylindrical body with a raised radial shoulder, a cylindrical mandrel extending from the second end of the first piston and being axially aligned with the cylindrical body, a cylinder head coupled to the second end of the cylindrical body and axially aligned with the cylindrical body and having an inner radial face with the cylindrical mandrel located therethrough, an impact dampening material in contact with the inner radial face, wherein the impact dampening material absorbs the energy of the piston moving downhole within the cylindrical body without a dampening fluid.

A variation of the example embodiment may include a power charge located proximate to the first cylindrical body, wherein gases generated by the power charge can enter second cylindrical body. It may include a firing head coupled to the power charge.

An example embodiment may include a method for setting a plug in a borehole comprising activating a firing head, starting a gas pressure generating chemical reaction, pressurizing a chamber located with a cylinder with the generated gas pressure, moving a piston disposed within the cylinder in a downhole axial direction with the generated gas, setting an expandable packer using the downhole motion of the piston, and impacting the first piston against an impact dampening material, wherein the impact stops the movement of the piston without the use of a hydraulic fluid.

A variation of the example embodiment may include placing a setting tool in a borehole at a predetermined location for installing a bridge plug. It may include shearing a shear stud coupled between a setting tool and a setting plug. It may include removing the setting tool from the borehole after setting a bridge plug. The expandable packer may be a bridge plug.

An example embodiment may include a setting tool apparatus comprising a first cylindrical body with an inner bore, a second cylindrical body with an inner bore, being coaxial with and coupled to the first cylindrical body, a third cylindrical body slideably with a first end engaged to the inner bore of the first cylindrical body and having an inner cavity with an axial opening at the first end adapted to accept a power charge and a having a distal end with a shoulder slideably engaged with the second cylindrical body inner bore, a fourth cylindrical body with a first end coupled to the distal end of the third cylindrical body and having a distal end with a transverse slot, a fifth cylindrical body fixed to the distal end of the second cylindrical body and having an inner bore wherein the fourth cylindrical body is slideably engaged therewith and further having a radial face within the second cylindrical body, a plurality of impact dampening discs with a hollow center having the fourth cylindrical body is located therethrough and coupled to the radial face of the fifth cylindrical body, a sixth cylindrical body coupled to the fifth cylindrical body and having a transverse slot; and wherein the shoulder of the third cylindrical body engages the plurality of impact dampening discs when the third cylindrical body travels a predetermined distance within the second cylindrical body.

A variation of the example embodiment may include the inner cavity of the third cylindrical body forming a power charge chamber. The fourth cylindrical body may be a piston. A chamber may be formed by the first piston and the cylindrical body. The plurality of impact dampening discs may be composed of a polyurethane energy-absorbing material. The plurality of impact dampening discs may be composed of polyborodimethylsiloxane. The plurality of impact dampening discs may be composed of a dilatant non-Newtonian fluid. The plurality of impact dampening discs may be composed of a closed cell polyurethane foam composite with polyborodimethylsiloxane as a dilatant dispersed through a foam matrix.

An example embodiment may include a setting tool apparatus comprising a cylindrical body having a center axis, a first end, a second end, an inner surface, and an outer surface, a first piston located within the cylindrical body and axially aligned with the cylindrical body, having a first end and a second end, the first end coupled to a second cylindrical body with a raised radial shoulder, a cylindrical mandrel extending from the second end of the first piston and being axially aligned with the cylindrical body, a cylinder head coupled to the second end of the cylindrical body and axially aligned with the cylindrical body and having an inner radial face with the cylindrical mandrel located therethrough, a plurality of impact dampening material disc inserts in contact with the inner radial face, and wherein the plurality of impact dampening material inserts absorb the energy of the piston moving downhole within the cylindrical body without a dampening fluid.

A variation of the example embodiment may include a power charge located proximate to the first cylindrical body, wherein gases generated by the power charge can enter second cylindrical body. It may include a firing head coupled to the power charge. It may include the plurality of impact dampening discs being composed of a polyurethane energy-absorbing material. The plurality of impact dampening material disc inserts may be composed of polyborodimethylsiloxane. The plurality of impact dampening material disc inserts may be composed of a dilatant non-Newtonian fluid. The plurality of impact dampening material disc inserts may be composed of a closed cell polyurethane foam composite with polyborodimethylsiloxane as a dilatant dispersed through a foam matrix.

An example embodiment may include a method for setting a plug in a borehole comprising activating a firing head, starting a gas pressure generating chemical reaction, pressurizing a chamber located with a cylinder with the generated gas pressure, moving a piston disposed within the cylinder in a downhole axial direction with the generated gas, setting an expandable packer using the downhole motion of the piston, impacting the piston against a plurality of impact dampening discs, absorbing the energy of the piston with the plurality of impact dampening discs, and stopping the movement of the piston with the plurality of impact dampening discs.

A variation of the example embodiment may include placing a setting tool in a borehole at a predetermined location for installing a bridge plug. It may include shearing a shear stud coupled between a setting tool and a setting plug. It may include removing the setting tool from the borehole after setting a bridge plug. The expandable packer may be a bridge plug.

BRIEF DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF EXAMPLES OF THE INVENTION

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

An example embodiment may include replacing the oil in a setting tool with an impact resistant material. This may remove the auxiliary chamber in some setting tools for oil to flow into which may reduce the overall length of the setting tool. The impact resistant material may provide a more reliable dampening system. The impact resistant material may improve the life of setting tools and the entire tools string by dampening shock typically seen from actuation of the setting tool, which travels throughout the tool string. Using an impact resistant material may provide for easier assembly in the field. The impact resistant material is molded into a preferred geometry that allows the user to install the material into a setting tool during assembly. Actuating the setting tool causes the material to compress at a constant rate to a predetermined volume. Upon reaching this predetermined volume the material acts as an impact dampener and absorbs and or dissipates energy seen as the setting tool's actuation exerts shock loading.

Figure 1:
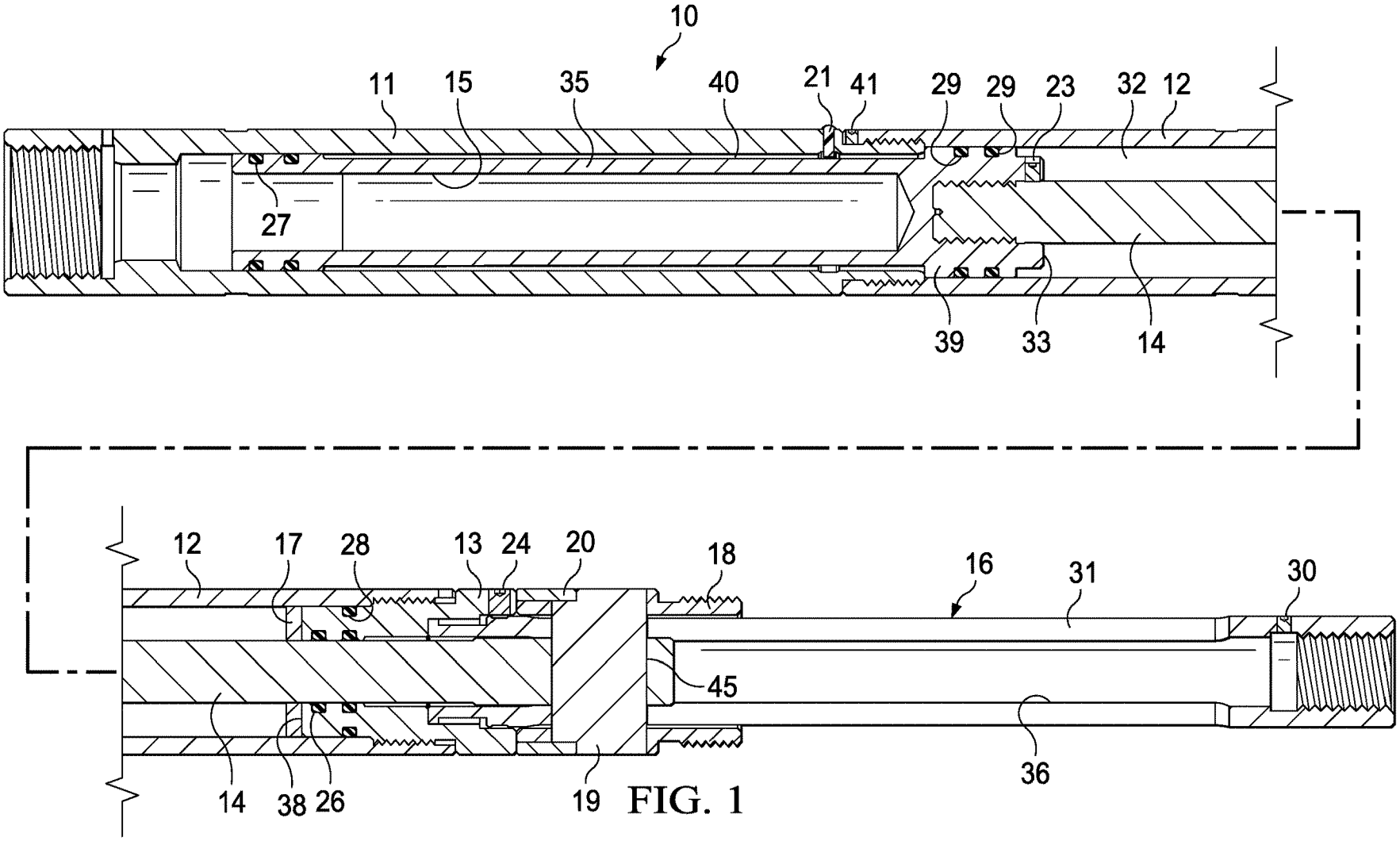
FIG. 1 shows an example embodiment of a side view of a setting tool prior to setting an expandable packer.

An example embodiment is shown in FIG. 1 from a side view cross-section of a setting tool prior to setting. A setting tool 10 may include a top cylinder 11 coupled to a lower cylinder 12. An upper cylinder 35 is slideably engaged with the top cylinder 11. The upper cylinder 35 includes an inner bore referred to as the power charge chamber 15. The upper cylinder 35 is coupled to a piston 14. Piston 14 slideably engaged with the inner bore 36 of the mandrel 16. Mandrel 16 is slideably engaged with the transfer sleeve 18. Transfer sleeve 18 is coupled via crosslink bolt 19 engaged with slot 45 to the distal end of piston 14. Crosslink bolt 19 in slideably engaged with the slot 31 of the mandrel 16. The cylinder head 13 is coupled to the lower portion of the lower cylinder 12. The upper portion of the lower cylinder 12 is coupled to the lower portion of the top cylinder 11. Cylinder head 13 includes a disk shaped impact resistance material 17 located on the inner face 38 of the cylinder head 13. The lower cylinder 12 combined with the piston 14, the shoulder face 33 of piston coupling 39, and the impact dampening material 17 form a chamber 32.

Nylon plug 21 seals off chamber 40 from the outside of the setting tool 10. O-rings 27 seal the upper cylinder 35 to the inner bore of top cylinder 11. Set screw 23 secures the top cylinder 11 to the lower cylinder 12. O-rings 29 seal the piston coupling 39 to the inner surface of lower cylinder 12. Set screw 41 secures the piston coupling 39 to the piston 14. O-rings 28 seal the cylinder head 13 to the inner surface of lower cylinder 12. O-rings 26 seal the cylinder head 13 to the piston 14. Set screw 24 secures the cylinder head 13 to the mandrel 16.

The impact resistant material 17 may be a viton based elastomer or a polyurethane energy absorbing material. An example impact resistant material 17 may include "D30", which is a polyurethane energy-absorbing material containing several additives and polyborodimethylsiloxane, a dilatant non-Newtonian fluid. Polyborodimethylsiloxane is a substance called a dilatant that in its raw state flows freely but on shock locks together to absorb and disperse energy as heat before returning to its semi fluid state. The commercial material known as "D3O" is in essence a closed cell polyurethane foam composite with polyborodimethylsiloxane (PBDMS) as the dilatant dispersed through the foam matrix which makes the product rate sensitive thus dissipating more energy than plain polyurethane at specific energy levels. An example of the optimal proportions for a shock absorbing foam composite formula may include, by volume, 15-35% of PBDMS and 40-70% fluid (the gas resulting from the foaming process, generally carbon dioxide) with the remainder being polyurethane.

Figure 2:
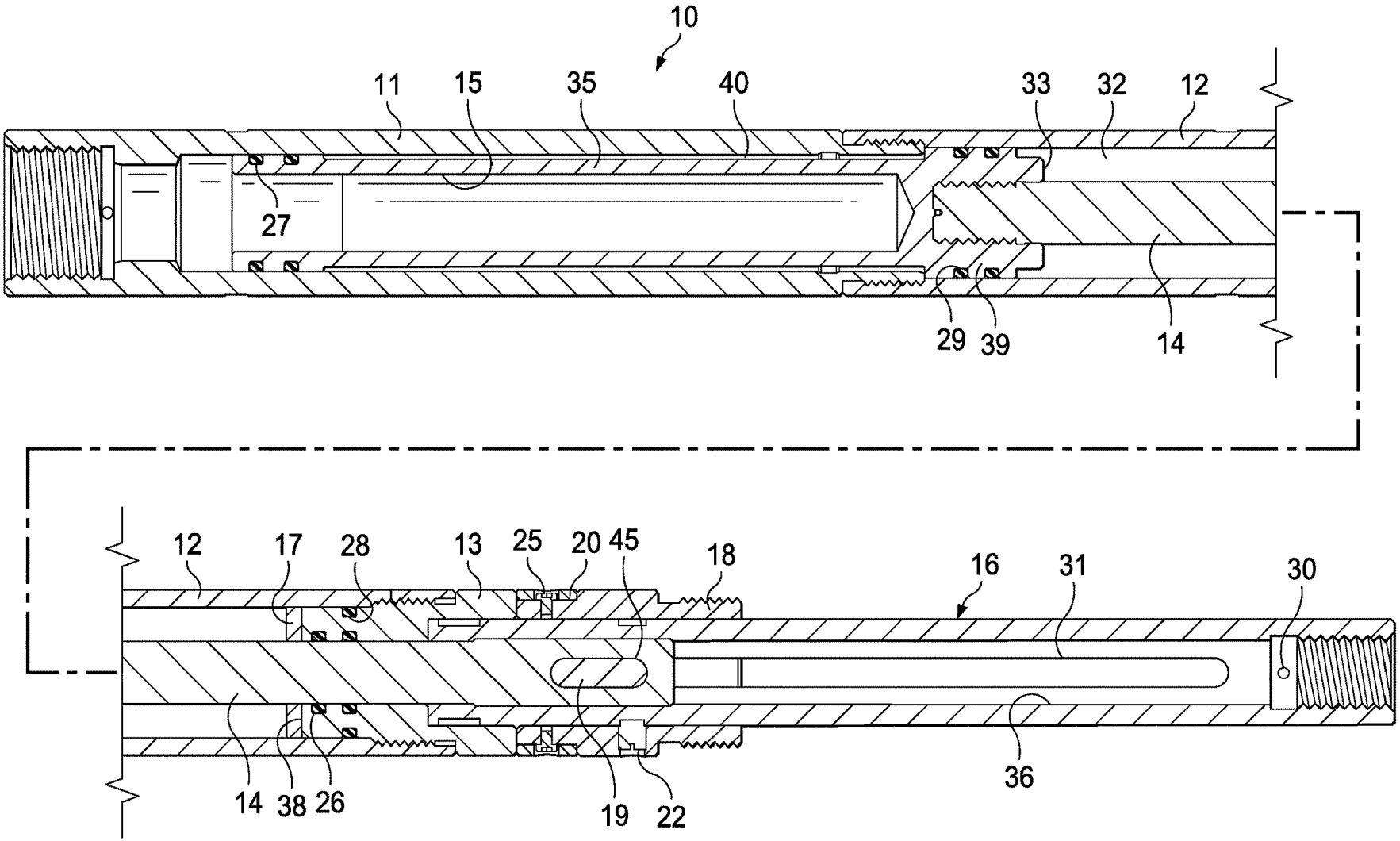
FIG. 2 shows an example embodiment of a side view of a setting tool prior to setting an expandable packer.

An example embodiment is shown in FIG. 2 from a top view cross-section of a setting tool prior to setting. The setting tool 10 may include a top cylinder 11 coupled to a lower cylinder 12. An upper cylinder 35 is slideably engaged with the top cylinder 11. The upper cylinder 35 includes an inner bore referred to as the power charge chamber 15. The upper cylinder 35 is coupled to a piston 14. Piston 14 slideably engaged with the inner bore 36 of the mandrel 16. Mandrel 16 is slideably engaged with the transfer sleeve 18. Transfer sleeve 18 is coupled via crosslink bolt 19 engaged with slot 45 to the distal end of piston 14. Crosslink bolt 19 in slideably engaged with the slot 31 of the mandrel 16. The cylinder head 13 is coupled to the lower portion of the lower cylinder 12. The upper portion of the lower cylinder 12 is coupled to the lower portion of the top cylinder 11. Cylinder head 13 includes a disk shaped impact resistance material 17 located on the inner face 38 of the cylinder head 13. The lower cylinder 12 combined with the piston 14, the shoulder face 33 of piston coupling 39, and the impact dampening material 17 form a chamber 32.

Nylon plug 21 seals off chamber 40 from the outside of the setting tool 10. O-rings 27 seal the upper cylinder 35 to the inner bore of top cylinder 11. Set screw 23 secures the top cylinder 11 to the lower cylinder 12. O-rings 29 seal the piston coupling 39 to the inner surface of lower cylinder 12. Set screw 41 secures the piston coupling 39 to the piston 14. O-rings 28 seal the cylinder head 13 to the inner surface of lower cylinder 12. O-rings 26 seal the cylinder head 13 to the piston 14. Set screw 24 secures the cylinder head 13 to the mandrel 16. Set screw 25 secures the retention ring 20 to the transfer sleeve 18. Set screw 22 may secure the transfer sleeve 18 to the mandrel 16.

Figure 3:
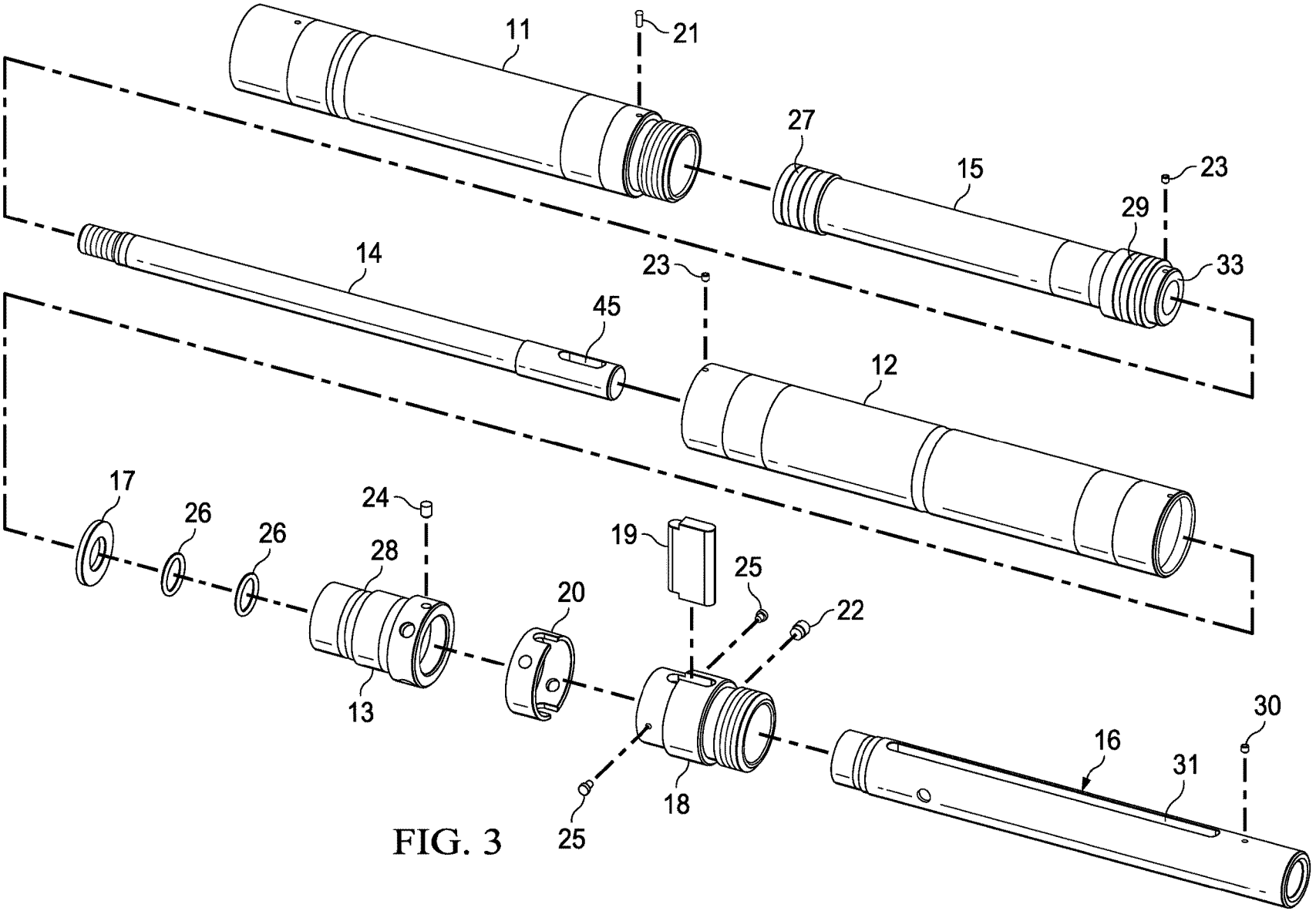
FIG. 3 shows an example embodiment of an exploded view of a setting tool.

An example embodiment is shown in FIG. 3 using an assembly view cross-section of a setting tool. The setting tool 10 may include a top cylinder 11 coupled to a lower cylinder 12. An upper cylinder 35 is slideably engaged with the top cylinder 11. The upper cylinder 35 includes an inner bore referred to as the power charge chamber 15. The upper cylinder 35 is coupled to a piston 14. Piston 14 slideably engaged with the inner bore 36 of the mandrel 16. Mandrel 16 is slideably engaged with the transfer sleeve 18. Transfer sleeve 18 is coupled via crosslink bolt 19 engaged with slot 45 to the distal end of piston 14. Crosslink bolt 19 in slideably engaged with the slot 31 of the mandrel 16. The cylinder head 13 is coupled to the lower portion of the lower cylinder 12. The upper portion of the lower cylinder 12 is coupled to the lower portion of the top cylinder 11. Cylinder head 13 includes a disk shaped impact resistance material 17 located on the inner face 38 of the cylinder head 13. The lower cylinder 12 combined with the piston 14, the shoulder face 33 of piston coupling 39, and the impact dampening material 17 form a chamber 32. Transfer sleeve 18 is coupled via crosslink bolt 19 engaged with slot 45 to the distal end of piston 14.

Nylon plug 21 seals off chamber 40 from the outside of the setting tool 10. O-rings 27 seal the upper cylinder 35 to the inner bore of top cylinder 11. Set screw 23 secures the top cylinder 11 to the lower cylinder 12. O-rings 29 seal the piston coupling 39 to the inner surface of lower cylinder 12. Set screw 41 secures the piston coupling 39 to the piston 14. O-rings 28 seal the cylinder head 13 to the inner surface of lower cylinder 12. O-rings 26 seal the cylinder head 13 to the piston 14. Set screw 24 secures the cylinder head 13 to the mandrel 16. Set screw 25 secures the retention ring 20 to the transfer sleeve 18. Set screw 30 may assist in securing an expandable packer, sealing device, or other suitable element to the end of mandrel 16.

Figure 4:
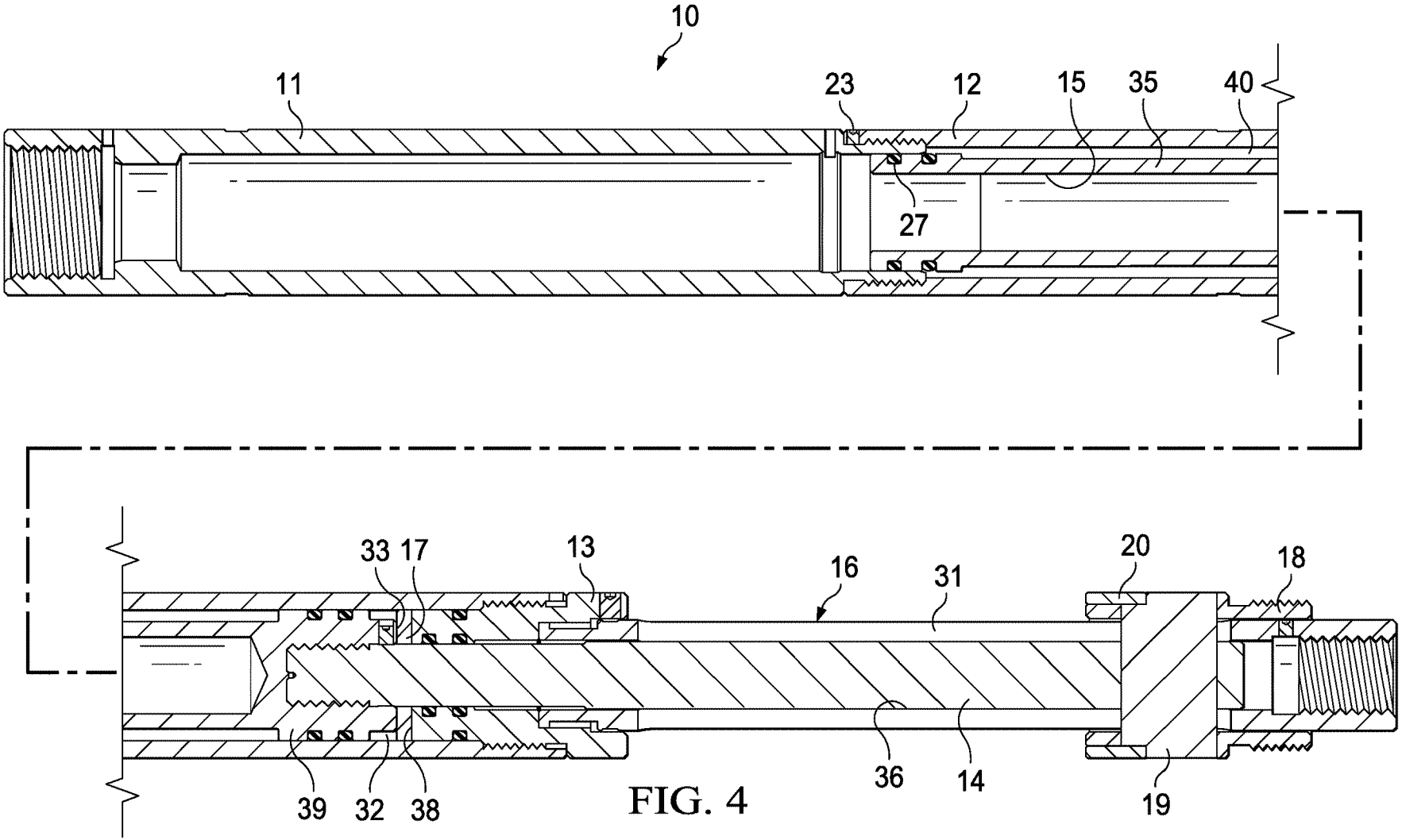
FIG. 4 shows an example embodiment of a side view of a setting tool after setting an expandable packer.

An example embodiment is shown in FIG. 4 from a side view cross-section of a setting tool after the setting tool has been activated. The setting tool 10 may include a top cylinder 11 coupled to a lower cylinder 12. An upper cylinder 35 is slideably engaged with the top cylinder 11. The upper cylinder 35 includes an inner bore referred to as the power charge chamber 15. The upper cylinder 35 is coupled to a piston 14. Piston 14 slideably engaged with the inner bore 36 of the mandrel 16. Mandrel 16 is slideably engaged with the transfer sleeve 18. Transfer sleeve 18 is coupled via crosslink bolt 19 engaged with slot 45 to the distal end of piston 14. Crosslink bolt 19 in slideably engaged with the slot 31 of the mandrel 16. The cylinder head 13 is coupled to the lower portion of the lower cylinder 12. The upper portion of the lower cylinder 12 is coupled to the lower portion of the top cylinder 11. Cylinder head 13 includes a disk shaped impact resistance material 17 located on the inner face 38 of the cylinder head 13. The lower cylinder 12 combined with the piston 14, the shoulder face 33 of piston coupling 39, and the impact dampening material 17 form a chamber 32.

Nylon plug 21 seals off chamber 40 from the outside of the setting tool 10. O-rings 27 seal the upper cylinder 35 to the inner bore of top cylinder 11. Set screw 23 secures the top cylinder 11 to the lower cylinder 12. O-rings 29 seal the piston coupling 39 to the inner surface of lower cylinder 12. Set screw 41 secures the piston coupling 39 to the piston 14. O-rings 28 seal the cylinder head 13 to the inner surface of lower cylinder 12. O-rings 26 seal the cylinder head 13 to the piston 14. Set screw 24 secures the cylinder head 13 to the mandrel 16. Set screw 25 secures the retention ring 20 to the transfer sleeve 18.

Still referring to FIG. 4 the shoulder face 33 is in contact with the impact resistance material 17 located on the inner face 38 of the cylinder head 13. The chamber 32 is substantially collapsed from its original size. The transfer sleeve 18 has been fully extended along the length of the mandrel 16. This results in a push-pull effect where a packer or other expandable attached to the mandrel is pulled against the force exerted from the sliding transfer sleeve 18. Such combination of forces allows for compressing rubber and or metal sealing surfaces together, forcing radial expansion against a wellbore, thus sealing the wellbore. Once an expandable is set, the setting tool can be removed from the expandable by a pulling force from the surface which causes a shear pin or other intentionally breakable component to intentionally fail, thus leaving the expandable in place as the setting tool is pulled uphole.

Figure 5:
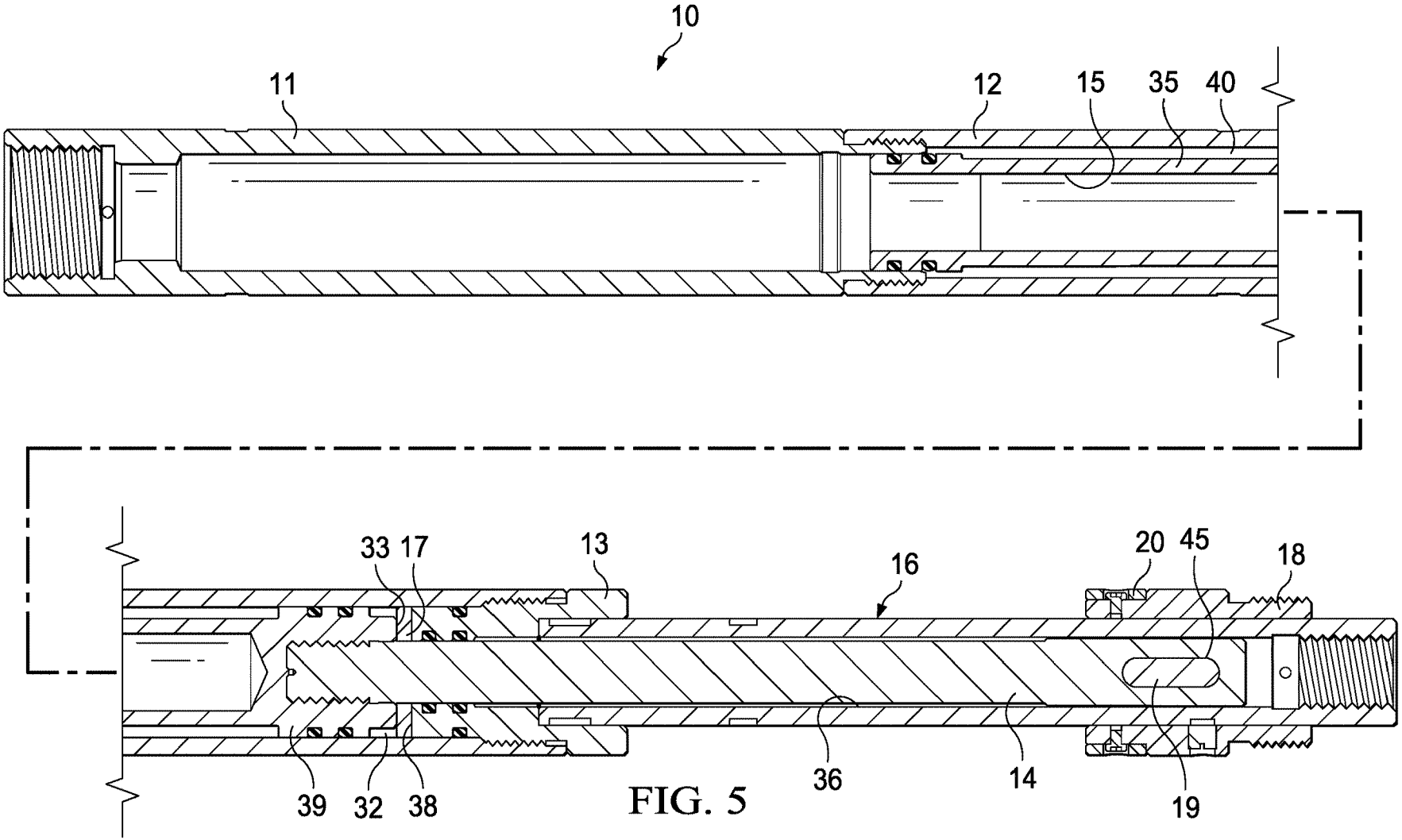
FIG. 5 shows an example embodiment of a side view of a setting tool after setting an expandable packer.

An example embodiment is shown in FIG. 5 with a top view cross-section of a setting tool after the setting tool has been activated. The setting tool 10 may include a top cylinder 11 coupled to a lower cylinder 12. An upper cylinder 35 is slideably engaged with the top cylinder 11. The upper cylinder 35 includes an inner bore referred to as the power charge chamber 15. The upper cylinder 35 is coupled to a piston 14. Piston 14 slideably engaged with the inner bore 36 of the mandrel 16. Mandrel 16 is slideably engaged with the transfer sleeve 18. Transfer sleeve 18 is coupled via crosslink bolt 19 engaged with slot 45 to the distal end of piston 14. Crosslink bolt 19 in slideably engaged with the slot 31 of the mandrel 16. The cylinder head 13 is coupled to the lower portion of the lower cylinder 12. The upper portion of the lower cylinder 12 is coupled to the lower portion of the top cylinder 11. Cylinder head 13 includes a disk shaped impact resistance material 17 located on the inner face 38 of the cylinder head 13. The lower cylinder 12 combined with the piston 14, the shoulder face 33 of piston coupling 39, and the impact dampening material 17 form a chamber 32.

Figure 6:
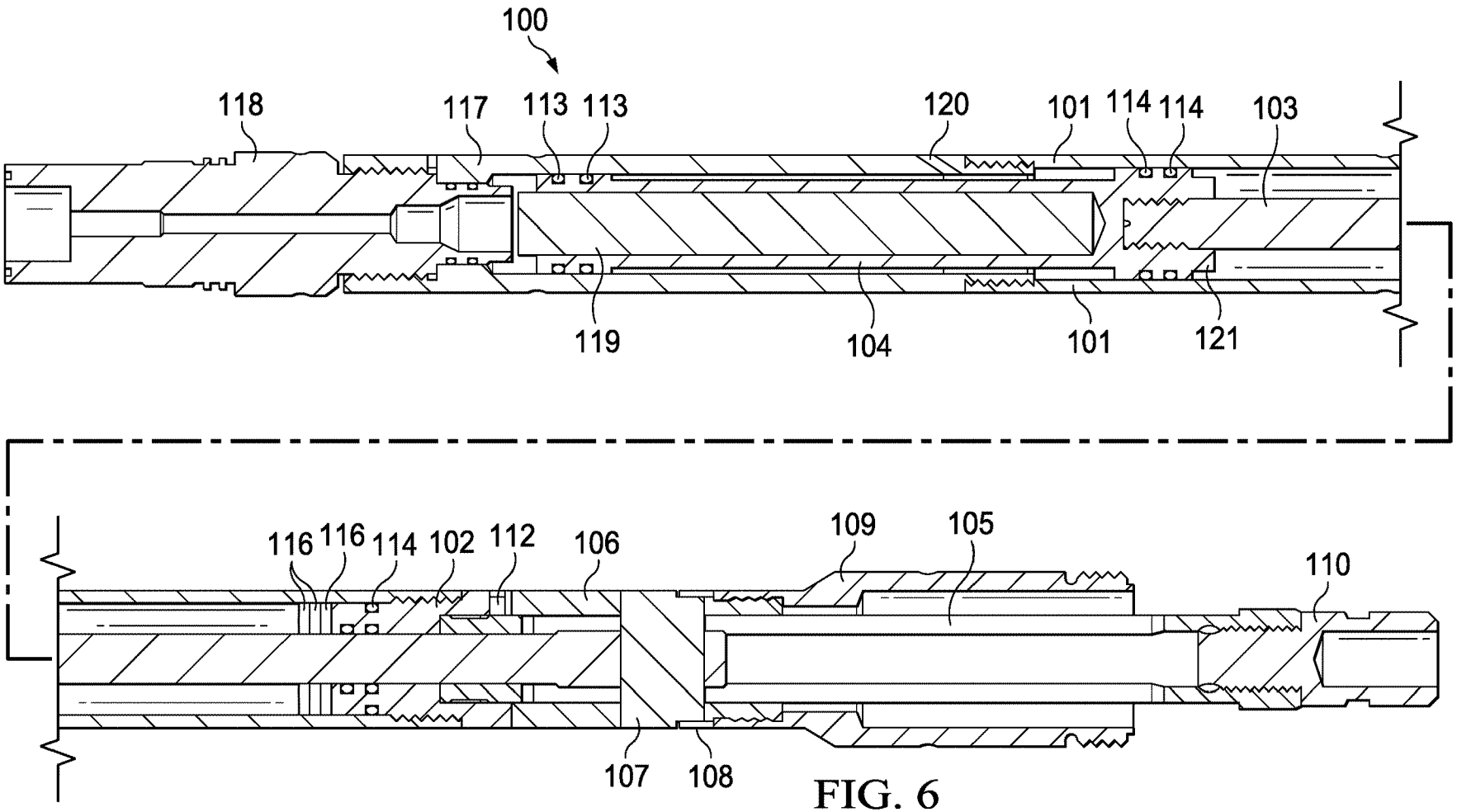
FIG. 6 shows an example embodiment of a cross-section view of a setting tool.
Figure 7:
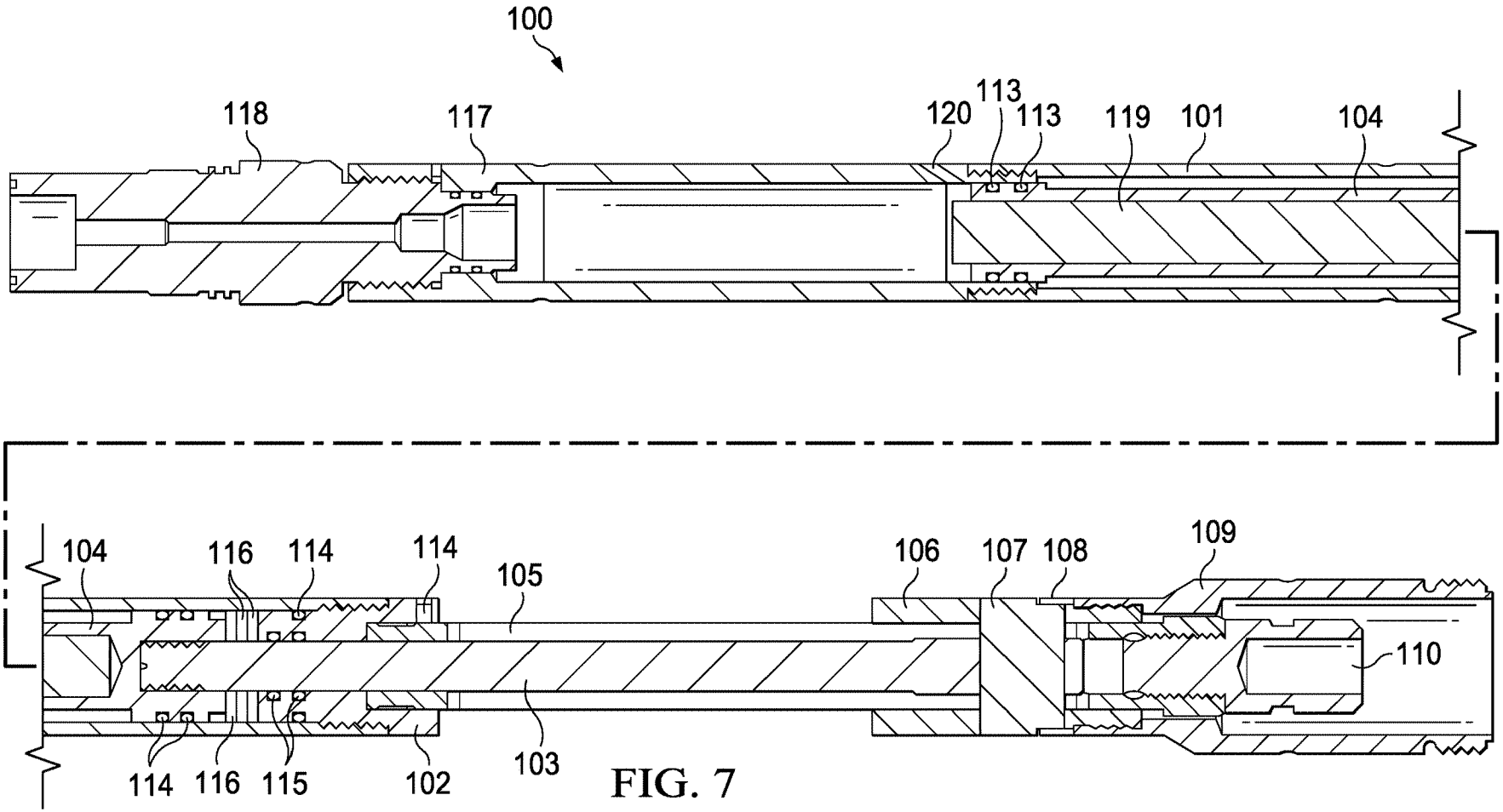
FIG. 7 shows an example embodiment of a cross-section view of a setting tool.

An alternative example embodiment is depicted in FIGS. 6 and 7 of an angled port system setting tool 100. It includes a lower cylinder 101. A power charge 119 is disposed within a power charge chamber 104. Power charge 104 is initially located proximate to firing head body 118. Power charge chamber 104 is slideably engaged with top cylinder 117. Top cylinder 117 is engaged with the lower cylinder 101. The power charge chamber 104 is sealed on one end against the top cylinder 117 via o-rings 113. The power charge chamber 104 has a head 121 that is slideably engaged with the lower cylinder 101 and sealed against the lower cylinder 101 via o-rings 114. Bleed-off port 120 is machined into top cylinder 117. Piston rod 103 is engaged to the head 121 of power charge chamber 104. Impact dampening material 116 is used to absorb the impact shock from head 121 against cylinder head 102. Impact dampening material 116 may be a plurality of disc shaped impact dampening inserts placed inside the hollow portion of lower cylinder 101. The plurality of impact dampening material 116 may be composed of the same material or it may alternate materials. Furthermore, oil could impregnate impact dampening material 116. Oil may also be located in between each of the plurality of impact dampening material 116. Cylinder head 102 is sealed against lower cylinder 101 via o-rings 114. Cylinder head 102 is sealed against the piston rod 103 slideably engaged thereto via o-rings 115. The piston rod 103 is engaged with the transfer sleeve 106 via crosslink 107. Retention ring 108 secures the crosslink 107 in place. Adaptor sleeve 109 is coupled to the transfer sleeve 106. Slotted mandrel 105 is engaged with the cylinder head 102 and secured with fastener 112. Piston rod 103 is slideably engaged within the slotted mandrel 105. Bottom connection 110 is coupled to the distal end slotted mandrel 105.

Bottom Angled Bleed-Off Port 120 that will utilize the pressure generated from the power charge 104 as a means to mitigate tool travel/tool movement during plug/packer setting applications. The pressure generated by the power charge 104 causes the tool to stroke and set a plug/packer in casing or tubing. Once the plug or packer is set pressure begins to increase until a thresh hold is reached and a shear or tensile mechanism designed into the plug or packer breaks. This reaction can cause a large "jump" or tool movement up-hole which can cause wireline to become tangled and/or damaged. The angled bleed off ports 120 will direct the large amount of pressure up-hole effectively acting as a breaking system for the tool 100 during the "jump" after the plug or packer has been set and the shear mechanism breaks.

Although the invention has been described in terms of embodiments which are set forth in detail, it should be understood that this is by illustration only and that the invention is not necessarily limited thereto. For example, terms such as upper and lower or top and bottom can be substituted with uphole and downhole, respectfully. Top and bottom could be left and right, respectively. Uphole and downhole could be shown in figures as left and right, respectively, or top and bottom, respectively. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. In a gun string such as described herein, the first gun may be the uphole gun or the downhole gun, same for the second gun, and the uphole or downhole references can be swapped as they are merely used to describe the location relationship of the various components. Terms like wellbore, borehole, well, bore, oil well, and other alternatives may be used synonymously. Terms like tool string, tool, perforating gun string, gun string, or downhole tools, and other alternatives may be used synonymously. The alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A setting tool apparatus comprising:

a first cylindrical body with an inner bore;

a second cylindrical body with an inner bore, being coaxial with and coupled to the first cylindrical body;

a third cylindrical body slideably engaged with a first end engaged to the inner bore of the first cylindrical body and having an inner cavity with an axial opening at the first end adapted to accept a power charge and a having a distal end with a shoulder slideably engaged with the second cylindrical body inner bore;

a fourth cylindrical body with a first end coupled to the distal end of the third cylindrical body and having a distal end with a transverse slot;

a fifth cylindrical body fixed to a distal end of the second cylindrical body and having an inner bore wherein the fourth cylindrical body is slideably engaged therewith and further having a radial face within the second cylindrical body;

a plurality of impact dampening discs composed of a closed cell polyurethane foam composite with polyborodimethylsiloxane as a dilatant non-Newtonian fluid dispersed through a foam matrix with a hollow center having the fourth cylindrical body located therethrough and coupled to the radial face of the fifth cylindrical body;

a sixth cylindrical body coupled to the fifth cylindrical body and having a transverse slot; and wherein the shoulder of the third cylindrical body engages the plurality of impact dampening discs when the third cylindrical body travels a predetermined distance within the second cylindrical body.

2. The apparatus of claim 1 wherein the inner cavity of the third cylindrical body forms a power charge chamber.

3. The apparatus of claim 1 wherein the fourth cylindrical body is piston.

4. The apparatus of claim 1 wherein a chamber is formed by a first piston and the inner bore of the second cylindrical body.

5. A setting tool apparatus comprising:

a cylindrical body having a center axis, a first end, a second end, an inner surface, and an outer surface;

a first piston located within the cylindrical body and axially aligned with the cylindrical body, having a first end and a second end, the first end coupled to a second cylindrical body with a raised radial shoulder;

a cylindrical mandrel extending from the second end of the first piston and being axially aligned with the cylindrical body;

a cylinder head coupled to the second end of the cylindrical body and axially aligned with the cylindrical body and having an inner radial face with the cylindrical mandrel located therethrough;

a plurality of impact dampening material discs composed of a closed cell polyurethane foam composite with polyborodimethylsiloxane as a dilatant non-Newtonian fluid dispersed through a foam matrix in contact with the inner radial face; and wherein the plurality of impact dampening material inserts absorb the energy of the first piston moving downhole within the cylindrical body without a dampening fluid.

6. The apparatus of claim 5 further comprising a power charge located proximate to the cylindrical body, wherein gases generated by the power charge can enter second cylindrical body.

7. The apparatus of claim 6 further comprising a firing head coupled to the power charge.

8. A method for setting a plug in a borehole comprising:

activating a firing head;

starting a gas pressure generating chemical reaction;

pressurizing a chamber located with a cylinder with the generated gas pressure;

moving a piston disposed within the cylinder in a downhole axial direction with the generated gas;

setting an expandable packer using the downhole motion of the piston;

impacting the piston against a plurality of impact dampening discs composed of a closed cell polyurethane foam composite with polyborodimethylsiloxane as a dilatant non-Newtonian fluid dispersed through a foam matrix;

absorbing the energy of the piston with the plurality of impact dampening discs; and stopping the movement of the piston with the plurality of impact dampening discs.

9. A method as in claim 8 further comprising placing a setting tool in a borehole at a predetermined location for installing a bridge plug.

10. A method as in claim 8 further comprising shearing a shear stud coupled between a setting tool and a setting plug.

11. A method as in claim 8 further comprising removing the setting tool from the borehole after setting a bridge plug.

12. The method as in claim 8 wherein the expandable packer is a bridge plug.

* * * * *